United States Patent [19]

Helms

[11] Patent Number: 5,020,301

[45] Date of Patent: Jun. 4, 1991

[54] METHOD AND MACHINE FOR BALING SHRUBS AND BUSHES

[75] Inventor: Bernd Helms, Sparrieshoop, Fed. Rep. of Germany

[73] Assignee: W. Kordes' Söhne Rosenschulen GmbH & Co KG, Fed. Rep. of Germany

[21] Appl. No.: 445,715

[22] PCT Filed: Apr. 7, 1989

[86] PCT No.: PCT/EP89/00372

§ 371 Date: Nov. 21, 1989

§ 102(e) Date: Nov. 21, 1989

[87] PCT Pub. No.: WO89/09728

PCT Pub. Date: Oct. 19, 1989

[30] Foreign Application Priority Data

Apr. 13, 1988 [DE] Fed. Rep. of Germany ..... 3812273

[51] Int. Cl.[5] ..... B65B 11/02; B65B 13/16; B65B 27/12

[52] U.S. Cl. ..... 53/399; 53/239; 53/453; 53/474; 53/528; 53/559; 53/579; 53/590

[58] Field of Search ..... 53/205, 209, 210, 218, 53/397, 399, 453, 464, 465, 466, 528, 559, 574, 578, 579, 582, 590, 239, 474, 594; 47/76, 78, 901; 140/107

[56] References Cited

U.S. PATENT DOCUMENTS

| | | | |
|---|---|---|---|
| 2,252,073 | 8/1941 | Gray | 47/78 |
| 2,907,157 | 10/1959 | Romine | 53/574 X |
| 3,063,197 | 11/1962 | Brooks | 53/397 |

FOREIGN PATENT DOCUMENTS

| | | | |
|---|---|---|---|
| 1857927 | 4/1962 | Fed. Rep. of Germany . | |
| 1511539 | 8/1970 | Fed. Rep. of Germany . | |
| 1346378 | 11/1962 | France . | |
| 2421551 | 11/1979 | France . | |
| 632208 | 9/1982 | Switzerland . | |
| 1187620 | 4/1970 | United Kingdom | 47/78 |

*Primary Examiner*—Robert L. Spruill
*Assistant Examiner*—Linda B. Johnson
*Attorney, Agent, or Firm*—Brumbaugh, Graves, Donohue & Raymond

[57] ABSTRACT

For baling shrubs or bushes, in particular rose bushes, the roots (12) of the plants (10) substantially freed from soil are embedded in a moisture-containing substrate (14) such as peat and provided with a sheath or envelope. For this purpose a hollow of wire grating (16) is formed which is then partially filled with substrate (14). Thereafter the roots (12) of the lying plant (10) are placed on the substrate (14). Further substrate (14) is then applied to the roots (12). Finally the wire grating (16) is deformed by bending two edges (24, 26) of the hollow together to form a tube and the edges (24, 26) of the wire grating (16) are fixedly connected together. A machine for carrying out this method comprises at least one trough (48) onto which the wire grating (16) can be placed. A ram (74) is shaped complementary to the trough (48) and adapted to be pressed into the latter to deform the wire grating (16) to a hollow. For fixedly holding the wire grating (16) at least at one longitudinal edge of the trough (48) a holding means (64) is provided and at least one flap (60, 62) for pivoting the wire grating (16) is pivotal about said longitudinal edge.

8 Claims, 7 Drawing Sheets

METHOD AND MACHINE FOR BALING SHRUBS AND BUSHES

Figure 1:
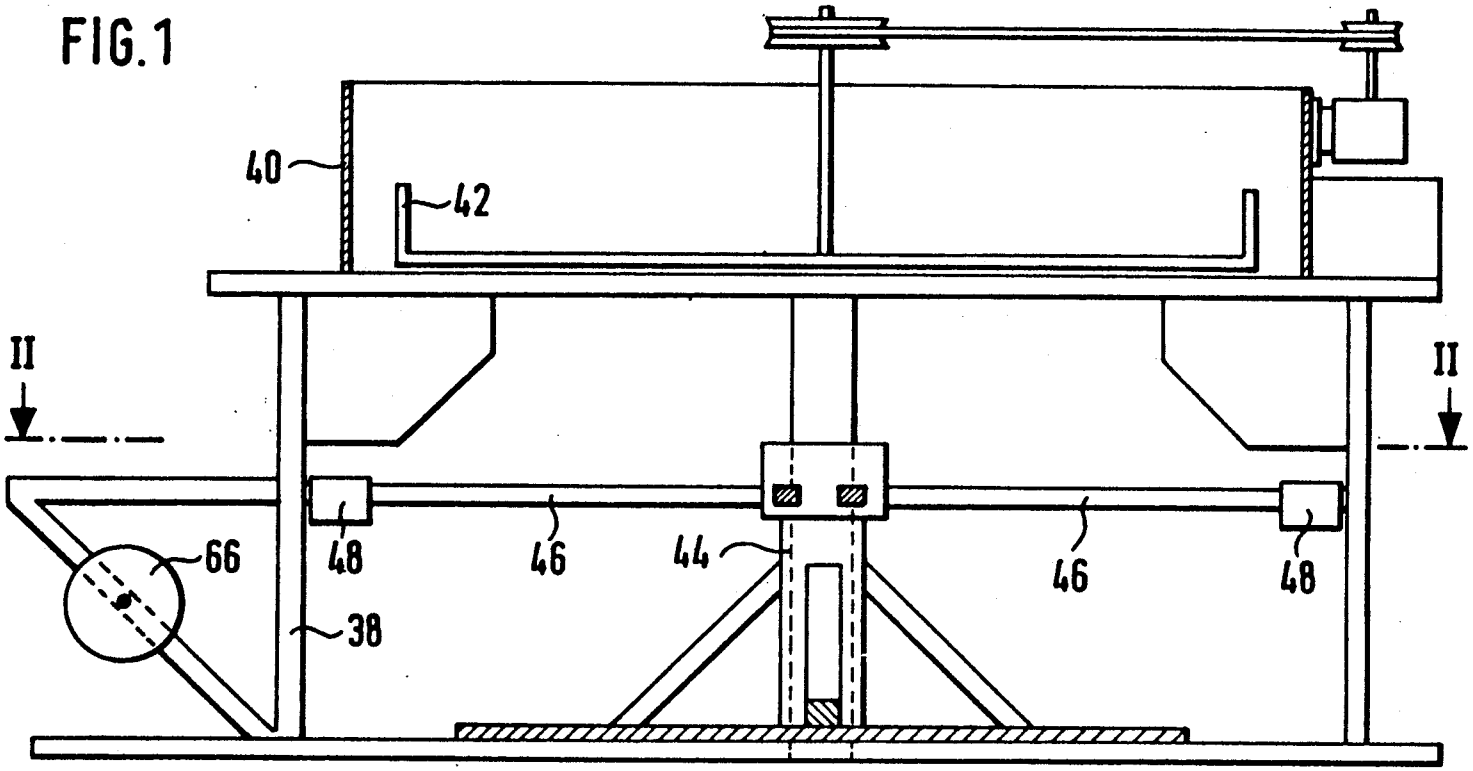

The invention relates to a method of baling shrubs and bushes, in particular rose bushes, in which a hollow is formed from wire grating in the form of a flat grating portion which at least at one of two edges remote from each other comprises protecting wire ends, the hollow is filled partially with a moisture-retaining substrate such as peat, the roots, substantially freed from soil, of the lying plant are placed on the substrate, further substrate is applied to the roots, the wire grating is formed to a tube by bending together said two edges, and said edges are fixedly connected together in that through meshes along one edge wire ends of the other edge are passed and said wire ends thereafter bent over.

The invention also relates to a machine for baling shrubs and bushes, in particular rose bushes, comprising at least one trough onto which a wire grating or netting may be placed.

German utility model 1,857,927 discloses an apparatus actuable by hand for baling shrubs and bushes in which at the upper side of a box-like container rectangular in plan view a mat of resilient material is suspended on a first rigid horizontal strip. By means of a linkage said strip is mounted on the container pivotally about an axis parallel to said strip. The mat hangs in the rest position on the first strip, forms in the container a trough of substantially semicircular cross-section, extends beyond the upper container edge remote from the first strip and has a free end to which a second rigid strip provided with a grip is secured. A wire grating or net is placed on the trough formed by the mat and some baling material poured onto said grating, the plant laid with its roots thereon, baling material again poured on and then the second strip provided with the grip and secured to the free end of the resilient mat pressed against the somewhat raised first strip secured to the linkage. As a result the bale material is given a cylindrical form and at the same time is enveloped in the wire grating under a certain pressure. Wire ends at the free end of the wire mesh are to be inserted through intermediate spaces at the opposite end thereof and by pressing the first strip bent and thereby close the cylinder formed by the wire grating or mesh.

Compared with purely manual baling of shrubs and bushes this known apparatus is advantageous; however, its handling is still rather complicated. Only with great skill, and then incompletely, is it possible to cause wire ends at one end of the wire grating to penetrate into meshes at the other end in such a manner that the wire ends can thereafter easily be bent over in hook-like manner to reliably close the cylinder formed. Mechanisation is hardly conceivable because the wire grating bends differently from case to case.

Baling of plants is carried out mainly for dispatching plants. For this purpose it is usual to join a large number of baled plants to a bunch or bundle, said plants for example being placed into a box or onto a pallet. Between bales cylindrically enclosed in the known manner hollow spaces remain which represent a very considerable loss of useful bunch volume and promote drying out of the plant bales during transport and storage.

The invention is therefore based on the problem of providing a method and a machine which make it possible to bale rose plants and other comparable shrub or bush plants in such a manner that they have a uniform cross-section, can be placed together in compact manner to form bunches and are thereby better protected against drying out and damage.

In so far as it relates to a method, the problem is solved with the features of claim 1 and in so far as it relates to a machine with the features of claim 2. Advantageous further developments are the subject of subsidiary claims.

Due to the bending of the wire grating according to the invention along exactly defined edge lines the plant bale is given a regularly polygonal, in particular quadratic, cross-section which ensures a reliable and also automatable penetration of free wire ends into opposite meshes of the wire grating so that the envelope formed by the wire grating can be reliably held. Due to the polygonal cross-sectional form of the bales hollow cavities between bales combined to form a bunch can be avoided. As a result, the plants are protected against drying out. Even when plants packed according to the invention are removed from a larger bunch the wire grating envelope remains reliably closed and as a result it is ensured that the plant bales are retained during the planting as well without appreciable substrate loss.

Figure 2:
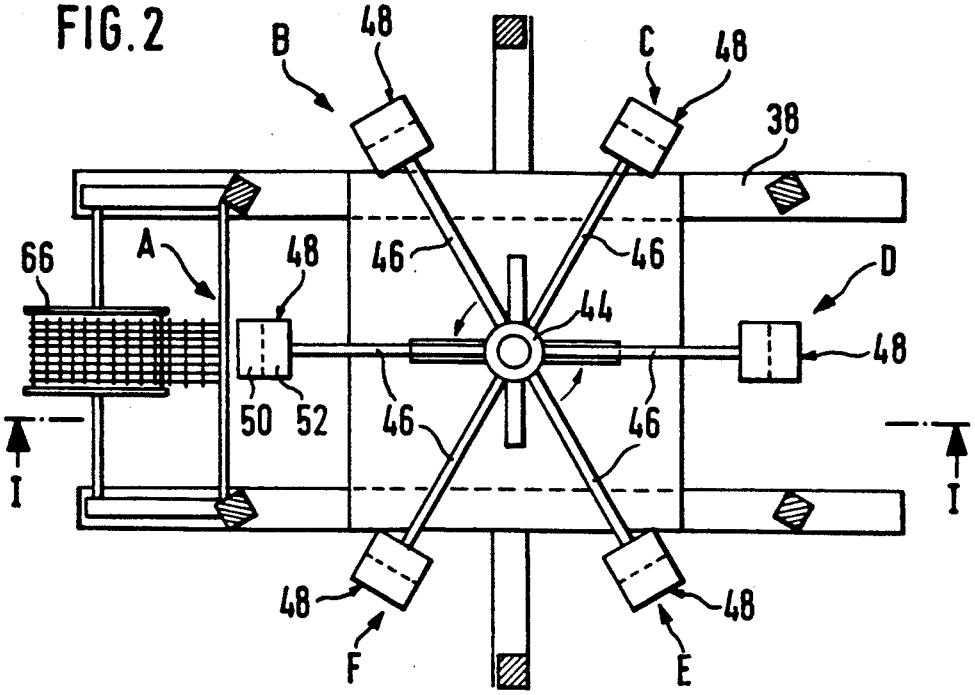
Figure 6:
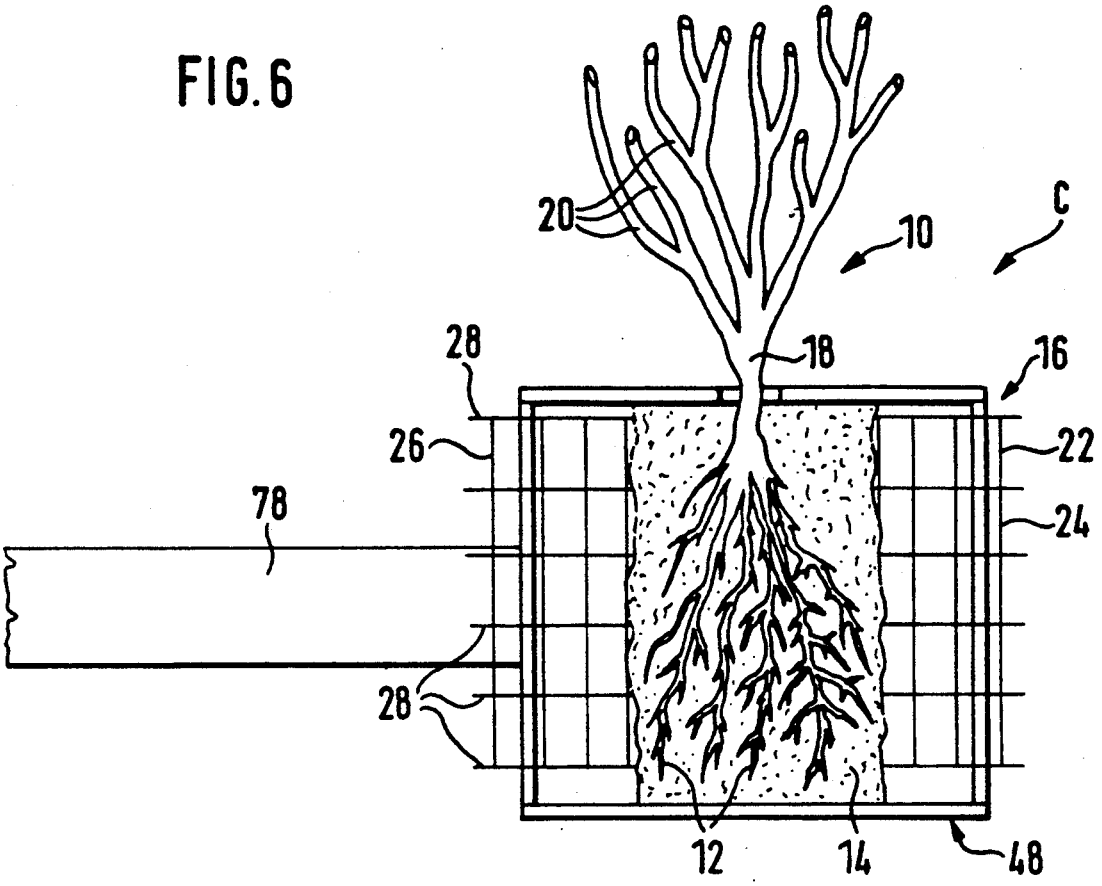
Figure 7:
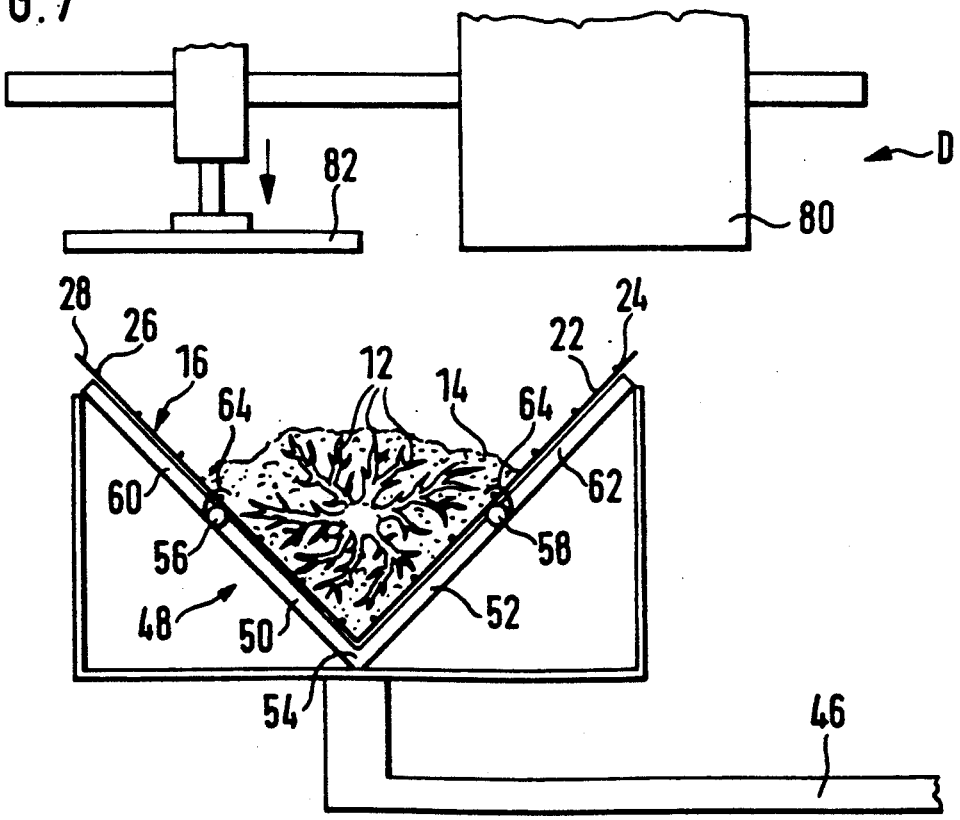
Figure 12:
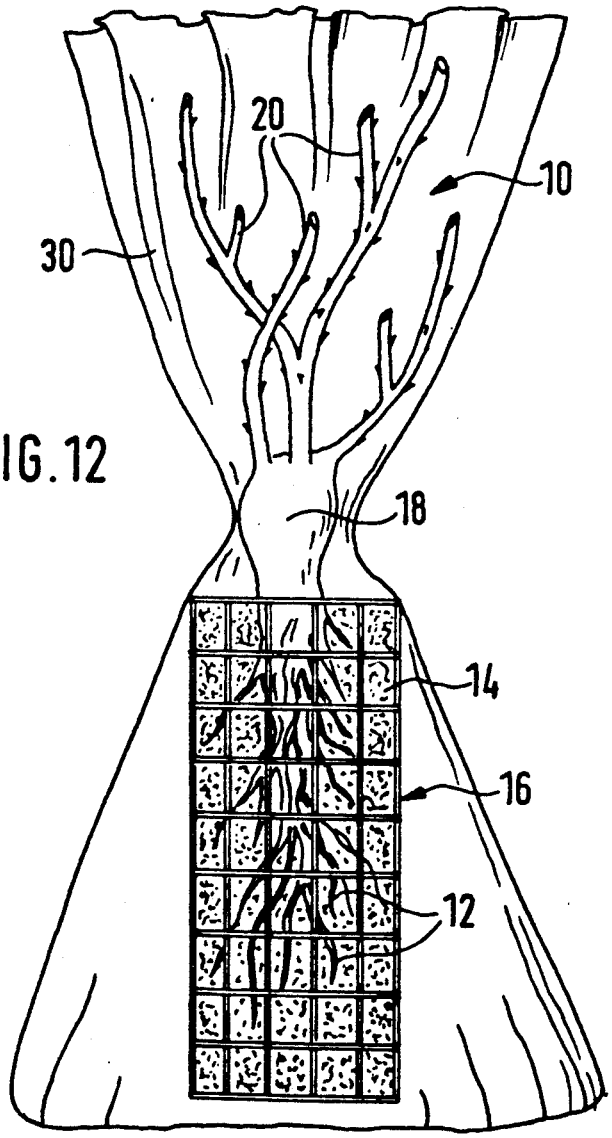

An example of embodiment of the machine according to the invention and its mode of operation and result will be explained in detail hereinafter with the aid of schematic drawings, wherein:

FIG. 1 shows a side elevation illustrated partially as vertical section I—I in FIG. 2 of a machine according to the invention, FIG. 2 shows the associated plan view partially as horizontal section II—II of FIG. 2, FIGS. 3 to 5 show the first to third working steps in baling a rose plant, in each case in side elevation, FIG. 6 is a plan view corresponding to FIG. 5, FIGS. 7 to 11 show the fourth to eighth working steps, each in side elevation and FIG. 12 shows a finished baled and packaged rose plant or bush.

The purpose of the machine illustrated is to bed a rose bush 10 which is delivered with roots 12 freed from soil, in a moisture-retaining substrate 14, for example peat, and enclose the substrate 14 with a wire grating 16 which thereby assumes the form of a slim tube of uniform quadratic cross-section over its entire length. The wire grating 16 should extend up to the vicinity of the graft point 18 of the rose bush 10 from which grafted shoots 20 originate.

The wire grating 16 has rectangular meshes 22 elongated in the horizontal direction. Two edges 24 and 26 of the wire grating 16 vertical for an upright rose bush 10 are each formed by a vertical wire which extends along a generatrix of the tube. The horizontal wires of the wire grating 16 are cut off short at the edge 24 but form wire ends 28 extending considerably over the other edge 26. Said wire ends 28 in the final state of the plant package, are each pushed through a mesh 22 adjoining the edge 24 and bent over in such a manner that the two edges 24 and 26 are fixedly connected together at all meshes 22.

The tube thus formed by the wire grating 16 and containing the substrate 14 and the roots 12 is finally placed in a manner not shown into a foil or sheet bag 30 of sheet which shrinks along two axes, said bag extending up to the level of the upper ends of the graft shoots 20 and being shrunk around the graft point 18 by external action of heat in such a manner that the sheet bag 30 closely encloses the tube formed by the wire grating 16.

The tube formed by the wire grating 16 may be cylindrical but preferably has a polygonal cross-section which is shown square in the example illustrated. This cross-section is formed in that a rectangular portion of the wire grating 16 is formed to a hollow by perpendicular bending along a first centre edge line 32 and said hollow first filled with about half the intended amount of substrate 14, whereupon the roots 12 of a plant 10 are placed thereon and the second half of the substrate 14 applied. The wire grating 16 is then edged or bent along a second edge line 34 which lies in the centre between the first edge line 32 and the edge 26 at which the projecting wire ends 28 are disposed. Finally, the wire grating 16 is bent along a third edge line 36 which lies in the centre between the first, edge line 32 and the edge 24. The wire ends 28 then enter through each mesh 22 at the edge 24 and are then bent over in hook-like manner, the edges 24 and 26 thus being fixedly connected together.

As an alternative, not illustrated, to this procedure the bendings may be carried out simultaneously along the edge lines 32 and 34 before the substrate 14 is applied and the roots 12 of a plant 10 laid thereon.

The machine illustrated has a machine frame 38 which carries a peat container 40 with stirring mechanism 42 disposed therein. Beneath the peat container 40 the machine frame 38 has a stationary column 44 in which an arm star having a plurality of horizontal arms 46 is rotatably mounted. In the example illustrated six arms 46 are provided at intervals of 60°. In corresponding angular intervals round the column 44 six working stations are disposed, i.e. a pressing station A, a first filling station B, an insert station C, a second filling station D, a closure station E and a removal station F. At the end of each arm 46 a trough 48 is secured in such a manner that on each revolution of the arm star it passes through all the working stations A to F.

Each trough 48 has two side walls 50 and 52 which are inclined to the horizontal by 45° in each case, enclosed between themselves at an angle of 90° and thus form an apex 54 which extends at a right-angle to the associated arm 46. Each of the two walls 50 and 52 is connected at its edge remote from the apex 54 and parallel to the latter by a hinge 56 or 58 to a flap 60 or 62. In the rest position the flap 60 lies in the same plane as the wall 50 whilst the flap 62 lies in the same plane as the wall 52. Arranged on each of the hinges 56 and 58 are a plurality of hook-like holding means 64.

Figure 3:
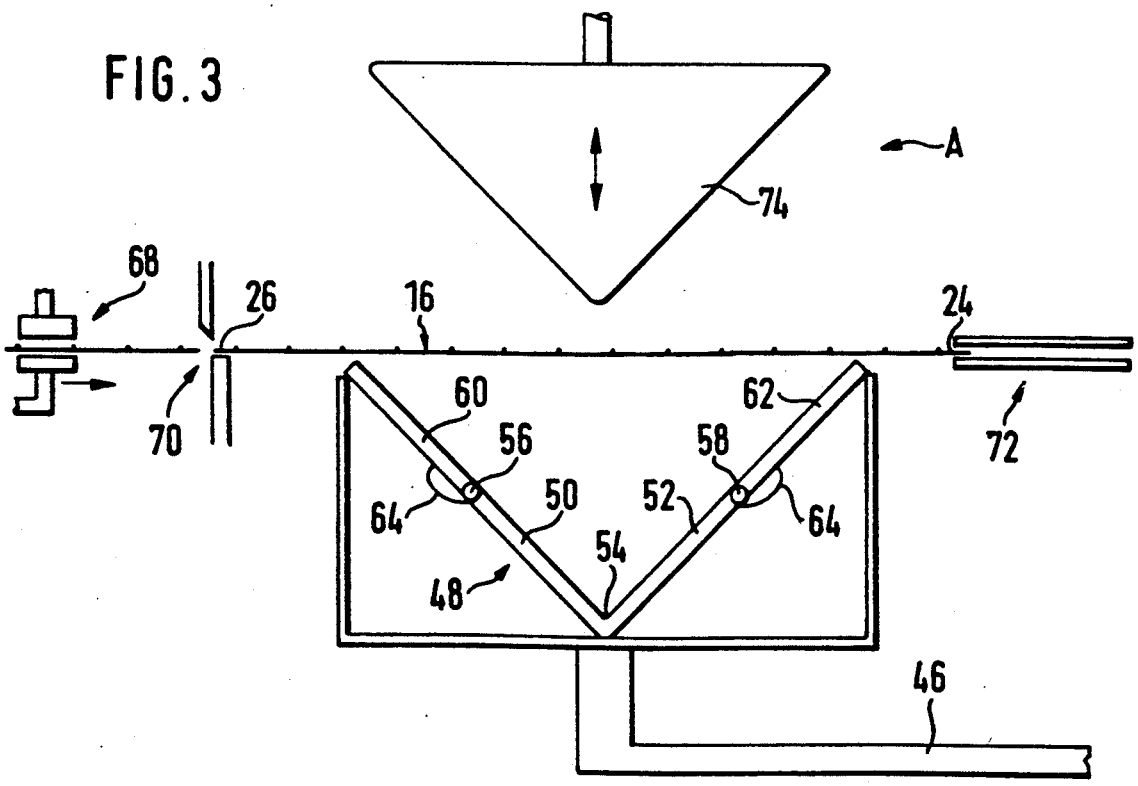
Figure 4:
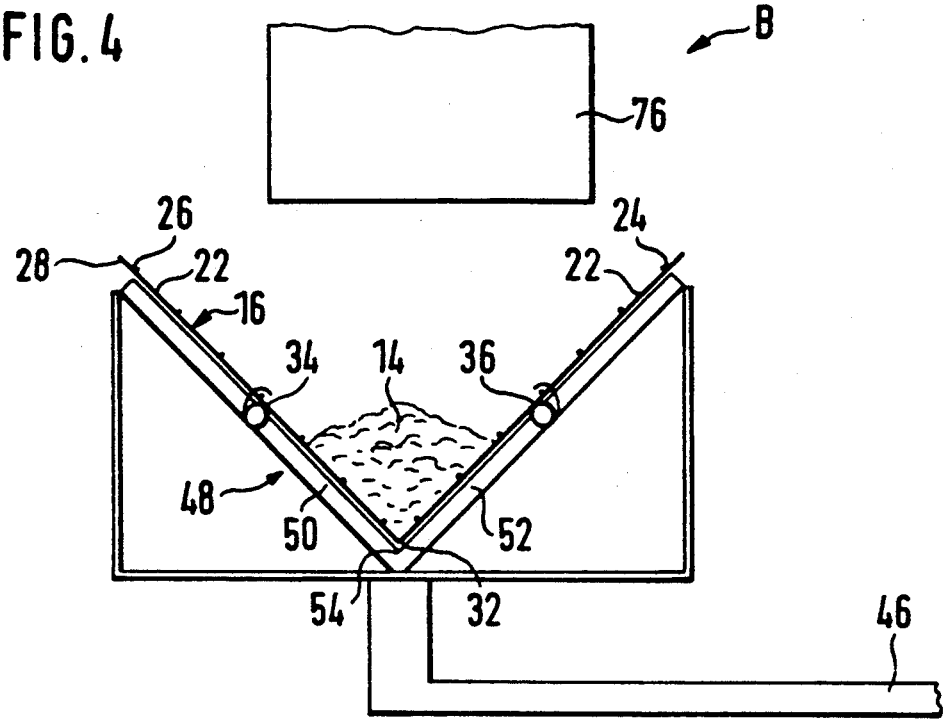
Figure 5:
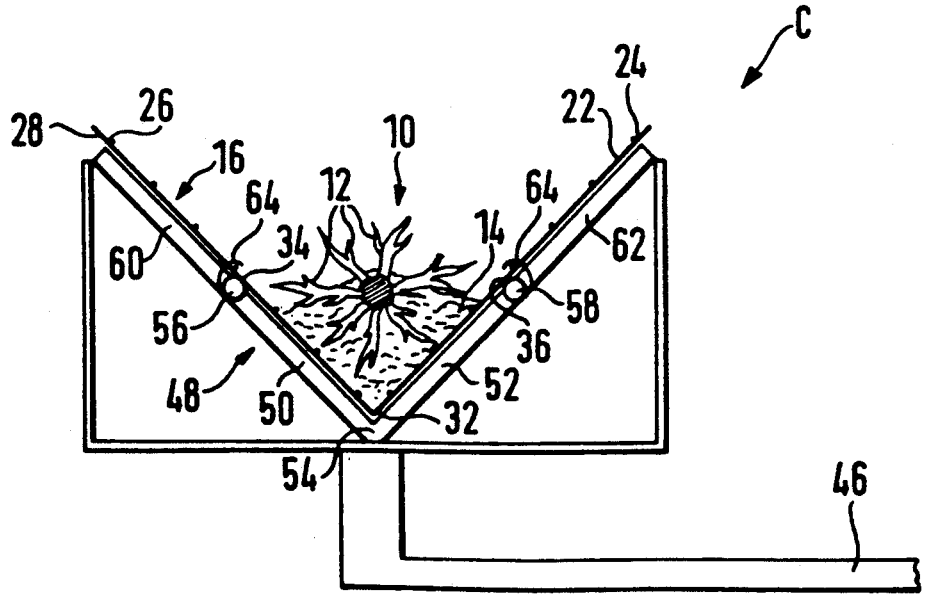

In the pressing station A a reel 66 is mounted from which the wire grating or meshing 16 can be uncoiled. The wire grating 16 runs via a guide 68 and from the latter further horizontally through a cutting means 70 up to a clamping means 72 which temporarily holds the respective leading end of the wire grating 16. In each working cycle the cutting means 70 cuts off a piece of wire grating 16 of which the length is appreciably greater than the distance between the upper free edges of the flaps 60 and 62 in their rest position. This is shown in FIG. 3; also illustrated therein is a ram 74 which has a cross-section complementary to the form of each trough 48 together with the opened flaps 60 and 62 and in each working cycle can be lowered into the trough 48 standing in the pressing station A in such a manner that the wire grating 16 lying thereon is bent at right-angles along its centre first edge line 32.

In the next working cycle the trough 48 involved reaches the first filling station B. There a proportioning means 76 is disposed which allows a predetermined amount of substrate 14 to run into the hollow formed by the wire grating 16. This amount of substrate 14 is approximately sufficient to fill the hollow formed by the wire grating 16 up to the vicinity of the hinges 56 and 58 at which the wire grating 16 is held by the hook-like holding means 64 each pivoted through a mesh 22.

In the next working cycle said trough 48 reaches the insertion station C in which a conveyor belt 78 for supplying the rose bushes 10 ends. Here a supervising operator places a rose bush 10 onto the wire grating 16 prepared in the manner described in such a manner that the roots 12 are slightly pushed into the substrate 14. After the next working cycle said trough 48 moves in the second filling station D beneath a further proportioning means 80 which allows a further predetermined amount of substrate 14 to run or trickle onto the roots 12 so that the latter are completely covered.

In the second filling station D in addition a ram 82 is disposed which alternately with the proportioning means 80 can be displaced into a position vertically above the trough 48 and lowered out of said position so that it compacts the substrate 14 and somewhat presses the roots 12 together.

Figure 8:
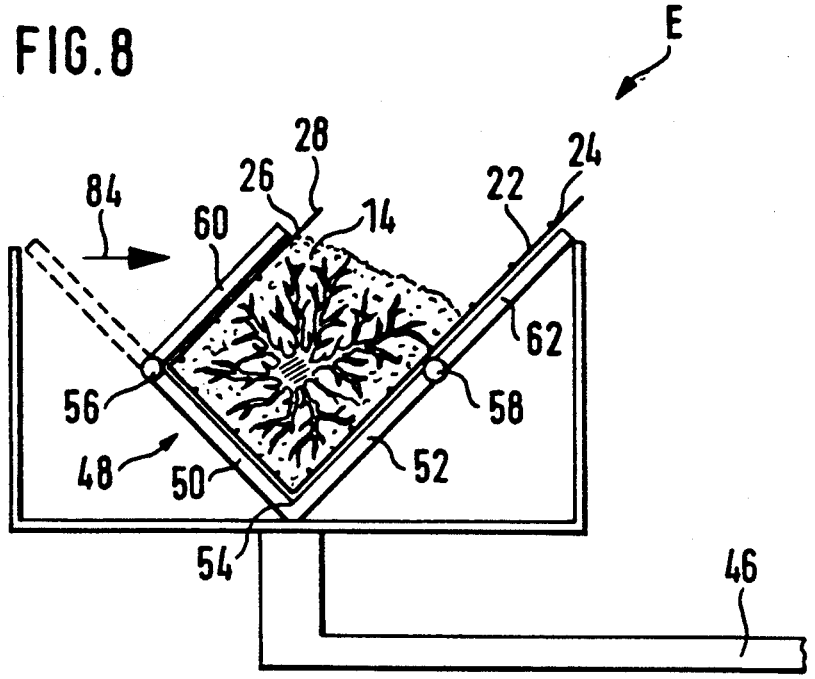
Figure 9:
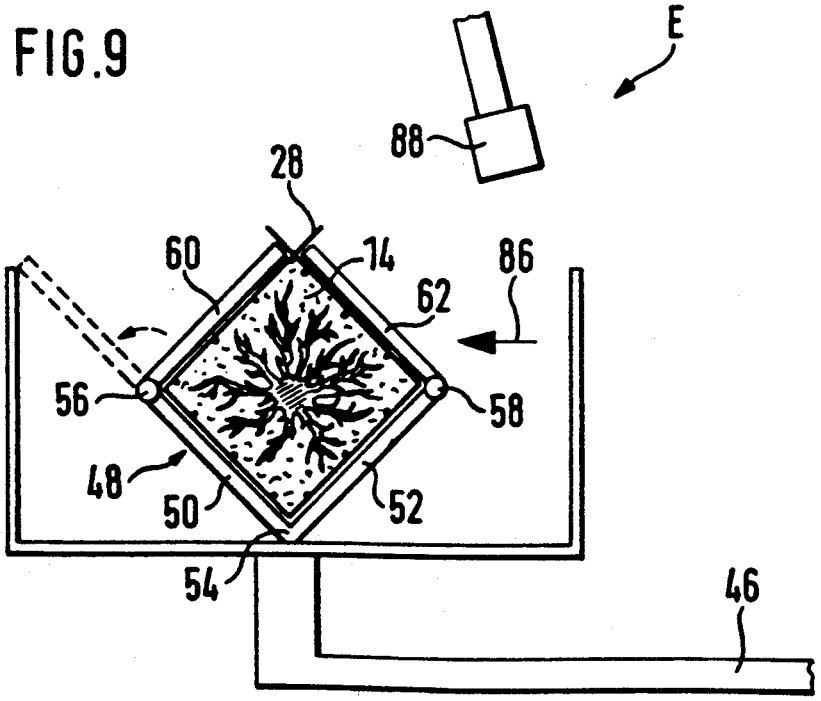
Figure 10:
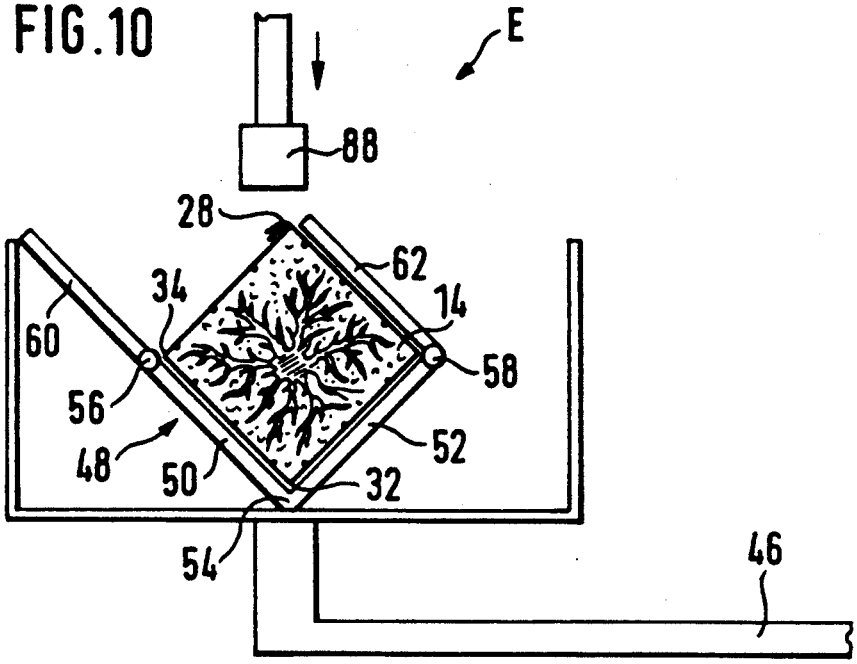
Figure 11:
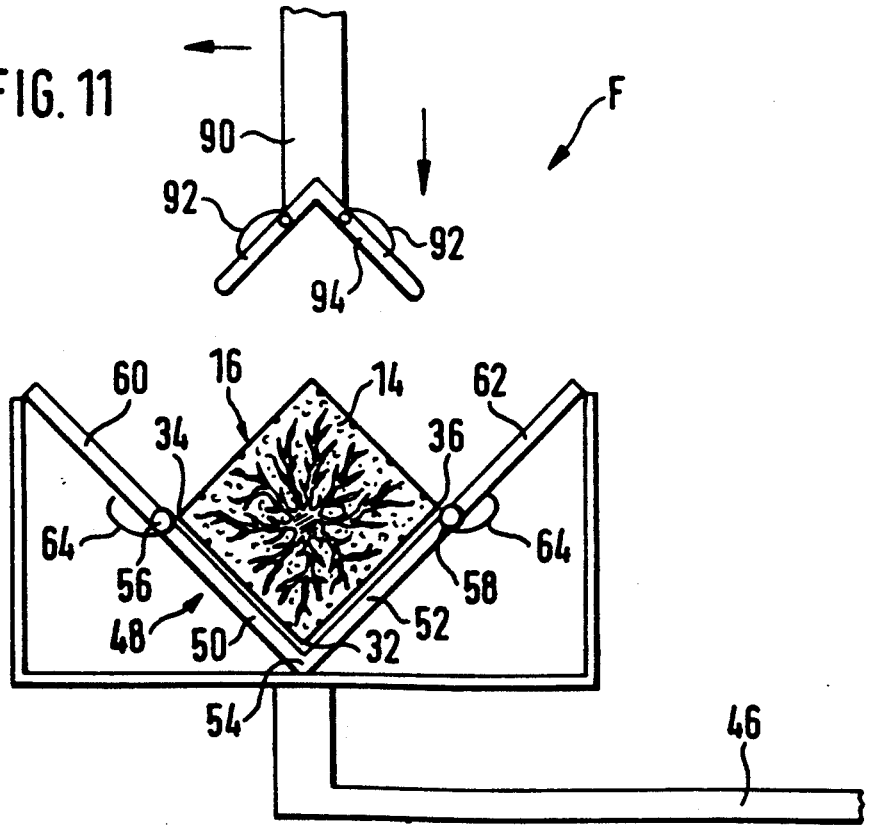

In the closing station E two horizontally displaceable push members 84 and 86 are disposed which in FIGS. 8 and 9 are shown only by an arrow respectively. Firstly, the push member 84 is activated so that it pivots the flap 60 through 90° into a position parallel to the wall 52. The wire grating 16 is thereby bent at right-angles along the second edge line 34. The edge 26 is then vertically above the first edge line 32; the wire ends 28 which extend upwardly parallel to the wall 52 are free, i.e. not covered by the flap 60. Thereafter the push member 86 is activated so that it pivots the flap 62 likewise through 90° and thereby bends the wire grating 16 at right angles along the third edge line 36. The wire ends 28 thereby each penetrate through a mesh 22 of the wire grating 16 adjacent the edge 24. Thereupon, still in the closing station E, the flap 60 is opened again and a further push member 88 executes a pendulum movement, clockwise in FIG. 9, during which it bends the wire ends 28 over. Directly thereafter the same push member 88, or another only vertically movable push member, is lowered in such a manner that it bends the wire ends 28 over completely. The wire grating 16 now forms a prismatic tube of square cross-section reliably sealed along a generatrix line.

In the next working cycle said trough 48 moves to the removal station F. In the latter a vertically and horizontally movable gripper 90 is disposed which comprises a plurality of hooks 92 at a downwardly open trough 94. The hooks 92 are controlled in such a manner that on lowering of the gripper 90 they engage into the two upper surfaces of the prismatic tube formed by the wire grating 16 and grip said tube. The trough 94 crushes said tube slightly further so that the substrate 14 contained therein is compacted to a somewhat greater extent and the wire ends are pressed completely into the interior of the tube so that on subsequent handling, for example on placing the baled rose bush 10 into a sheet bag 30, they are not an obstruction.

I claim:

1. In a method of baling bare rooted plants, which comprises the steps of (a) forming a hollow from a portion of a flat wire grating having edges at least one of the edges of the grating remote from the others having projecting wire ends, (b) partially filling the hollow with a moisture-retaining substrate, (c) placing the roots of the plant in a lying position substantially freed from soil on the substrate, (d) applying additional substrate to the roots, (e) forming the wire grating into a tube by bending together at least two edges thereof and (f) fixedly connecting the edges together by inserting wire ends of one edge through meshes along another edge and thereafter bending the wire ends over, the improvement comprising (i) forming the hollow in the wire grating by bending it approximately at right-angles along a first edge line which lies approximately in the centre between said two edges, (ii) after the steps (b), (c) and (d) above, again bending the wire grating approximately at right-angles along a second edge line which lies approximately in the centre between the first edge line and one of said edges, the wire grating being held fixed at said second edge line, and (iii) bending the wire grating again approximately at right-angles along a third edge line which lies substantially in the centre between the first edge line and the other of said edges, the wire grating being held fixed along said third edge line.

2. Machine for baling bare rooted plants, comprising (a) at least one trough onto which a wire grating can be placed, and wherein the trough is of V-shaped cross-section with two walls which are each inclined approximately 45 degrees to the horizontal and form a downwardly disposed apex, (b) a ram means arranged over the trough, the ram means being shaped complementary to the trough, with means for pressing the ram means into the trough to form the wire grating into a hollow, (c) hinge means in each of the walls of the trough and arranged spaced from the apex to a flap which is pivotal out of an open position in which said flap lies approximately in the same plane as an adjacent wall into a closure position in which with the adjacent wall said flap encloses at approximately a right-angle, and (d) a holding means arranged for fixedly holding the wire grating at each longitudal edge of the trough.

3. Machine according to claim 2, wherein at each hinge means, said holding means comprises, at least one hook-like holding means disposed for fixedly holding the wire grating while pivoting into the hollow formed thereby.

4. Machine according to claim 2 or 3, wherein (a) a plurality of troughs arranged at angular intervals from each other are rotatable jointly about a central axis and (b) around the central axis at angular intervals apart corresponding to the intervals of the troughs a plurality of working stations are disposed, including (c) a pressing station (A) with ram for deforming the wire grating to form a hollow, (d) a first filling station (B) with proportioning means for applying the substrate, (e) an insertion station (C) for inserting a plant into each trough, (f) a second filling station (D) with proportioning means for applying the substrate, (g) a closure station (E) for closing the flaps on the troughs and for connecting the edges of the wire gratings to form a baled plant and (h) a removal station (F) for removing the baled plant.

5. Machine according to claim 4, wherein the second filling station (D) includes a ram adapted to be brought alternately with the proportioning means into the working position for compacting the substrate.

6. Machine according to claim 5, wherein two oppositely movable push members are disposed at the closing station (E), for closing the flaps and wherein at least one further push member is disposed at the same location for bending over the wire ends of the wire gratings.

7. Machine according to claim 6, wherein a raisable and lowerably gripper is disposed at the removal station (F) which gripper comprises hooks for engaging the wire grating formed into a tube.

8. Machine according to claim 7, wherein the gripper comprises a downwardly open trough for subsequent compacting of the substrate surrounded by the tubular wire grating.

* * * * *